US006715998B2

(12) United States Patent
Virgilio

(10) Patent No.: US 6,715,998 B2
(45) Date of Patent: Apr. 6, 2004

(54) INTAKE REGULATOR FOR COMPRESSED AIR IN A RESERVOIR

(76) Inventor: Mietto Virgilio, Via Como, 17, 36051 Olmo di Creazzo (Vicenza) (IT)

( * ) Notice: Subject to any disclaimer, the term of this patent is extended or adjusted under 35 U.S.C. 154(b) by 84 days.

(21) Appl. No.: 10/113,769

(22) Filed: Apr. 1, 2002

(65) Prior Publication Data

US 2002/0155007 A1 Oct. 24, 2002

(30) Foreign Application Priority Data

Apr. 19, 2001 (IT) ..... VI2001A0086

(51) Int. Cl.[7] ..... F04B 49/00

(52) U.S. Cl. ..... 417/295; 417/298; 417/310; 418/DIG. 1

(58) Field of Search ..... 417/295, 298, 417/296, 310, 313; 418/DIG. 1, 201.2; 137/565.14; 251/30.02

(56) References Cited

U.S. PATENT DOCUMENTS

| | | | | | |
|---|---|---|---|---|---|
| 3,788,776 | A | * | 1/1974 | Post et al. | 417/295 |
| 4,068,980 | A | * | 1/1978 | Fine et al. | 417/282 |
| 4,147,475 | A | * | 4/1979 | Shoop et al. | 417/310 |
| 4,549,856 | A | * | 10/1985 | Cash et al. | 417/295 |
| 5,584,673 | A | * | 12/1996 | Rein | 417/308 |

FOREIGN PATENT DOCUMENTS

| | | | | |
|---|---|---|---|---|
| EP | 0 855 519 | A2 * | 7/1998 | F15B/1/33 |

* cited by examiner

*Primary Examiner*—Justine R. Yu
*Assistant Examiner*—Timothy P. Solak
(74) *Attorney, Agent, or Firm*—Bucknam & Archer

(57) ABSTRACT

The intake regulator of air (1) in a reservoir to be installed in a circuit for the production of compressed air, intercepts the air from the exterior and conveys the air to an oil bath spin compressor (2). The regulator is characterized by the fact that it is also fed by two flows of air under pressure (13 and (14), removed from the separator reservoir (3) and intercepted by three electrovalves (15), (16) and (17).

12 Claims, 5 Drawing Sheets

INTAKE REGULATOR FOR COMPRESSED AIR IN A RESERVOIR

FIELD OF THE INVENTION

This invention relates to an intake regulator for air in a reservoir, for instance of the type normally used for feeding an installation for the distribution of compressed air.

BACKGROUND OF THE INVENTION

In industrial applications, installations for the production of compressed air are well known. Such installations are constituted essentially by an oil bath spin compressor, an air/oil separator, a reservoir for the accumulation of pressurized air, a minimum pressure valve inserted in the conduit between the separator reservoir and the pressurized air reservoir and others, control units for regulation and safety such as thermostats, pressurestats and similar units. In particular, a valve which has the function of cutting off the passage of air from the exterior to the interior of the circuit is normally present upstream of the above installation. This valve, normally called a pressure regulator, some constructive forms of which have been disclosed in Italian Patent Nos. 85521/A/90, 1270555, 1270769 filed in the name of the applicant of the present application. The valve is applied on the orifice of the spin compressor intake and has the function of regulating and/or interrupting the flow of intake air from the exterior, as a function of the requirements of the functioning of the installation.

The intake regulator is constituted essentially by a slider capable of rectilinear alternating motion, caused by the balanceing effect between the pressure generated by the aspired exterior air and the pressure contrary to the preceeding one generated by the pressurized air from the circuit.

At the present state of the art, the operation of the intake regulator is possible only by using sufficiently complex circuits which utilize mechanical parts put in motion by means of springs, all this requiring a complex construction and causing a high cost of the regulator.

SUMMARY OF THE INVENTION

An object of the present invention is to provide an intake regulator of external air of very simple construction, being constituted by a monobloc in the interior of the conduits which is without elastic mechanical units such as the springs and which is also of simple maintenance.

BRIEF DESCRIPTION OF THE DRAWINGS

The characteristics of the invention are described herein below in detail by means of the attached drawings which illustrate a possible embodiment offered only by way of illustration on a non-limiting example, of which.

DETAILED DESCRIPTION OF THE INVENTION

Figure 1:
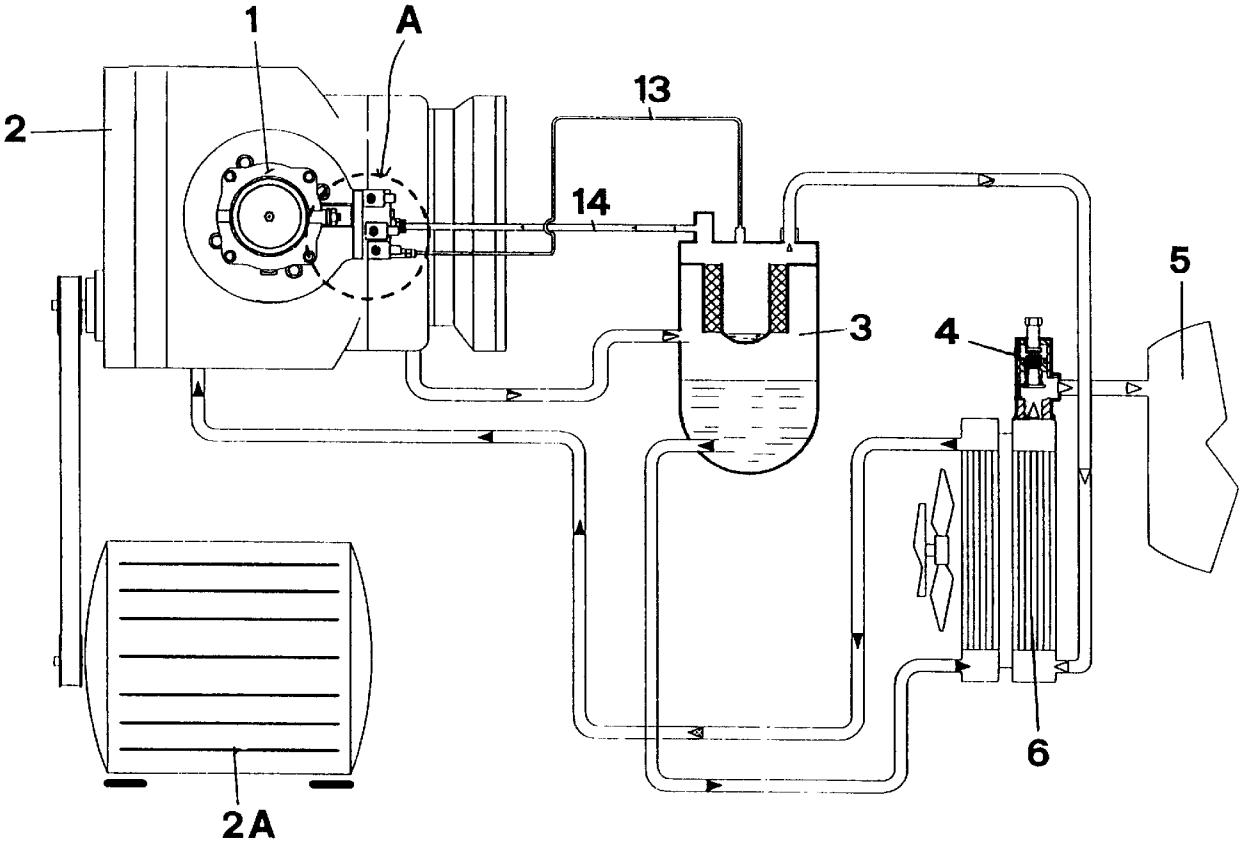
FIG. 1 shows a general scheme of an installation for the production of compressed air by means of a oil bath spin compressor provided with an automatic regulator according to this invention.
Figure 1A:
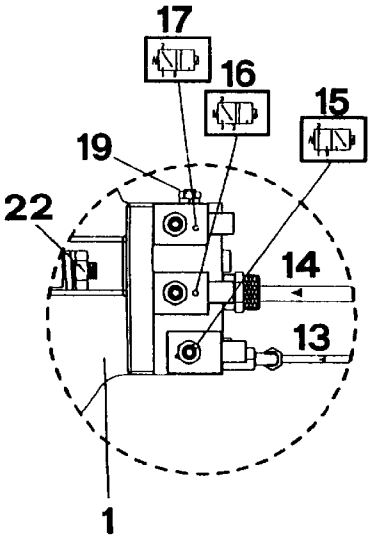
FIG. 1A shows an enlarged view of the particular portion marked "A" in FIG. 1.
Figure 2:
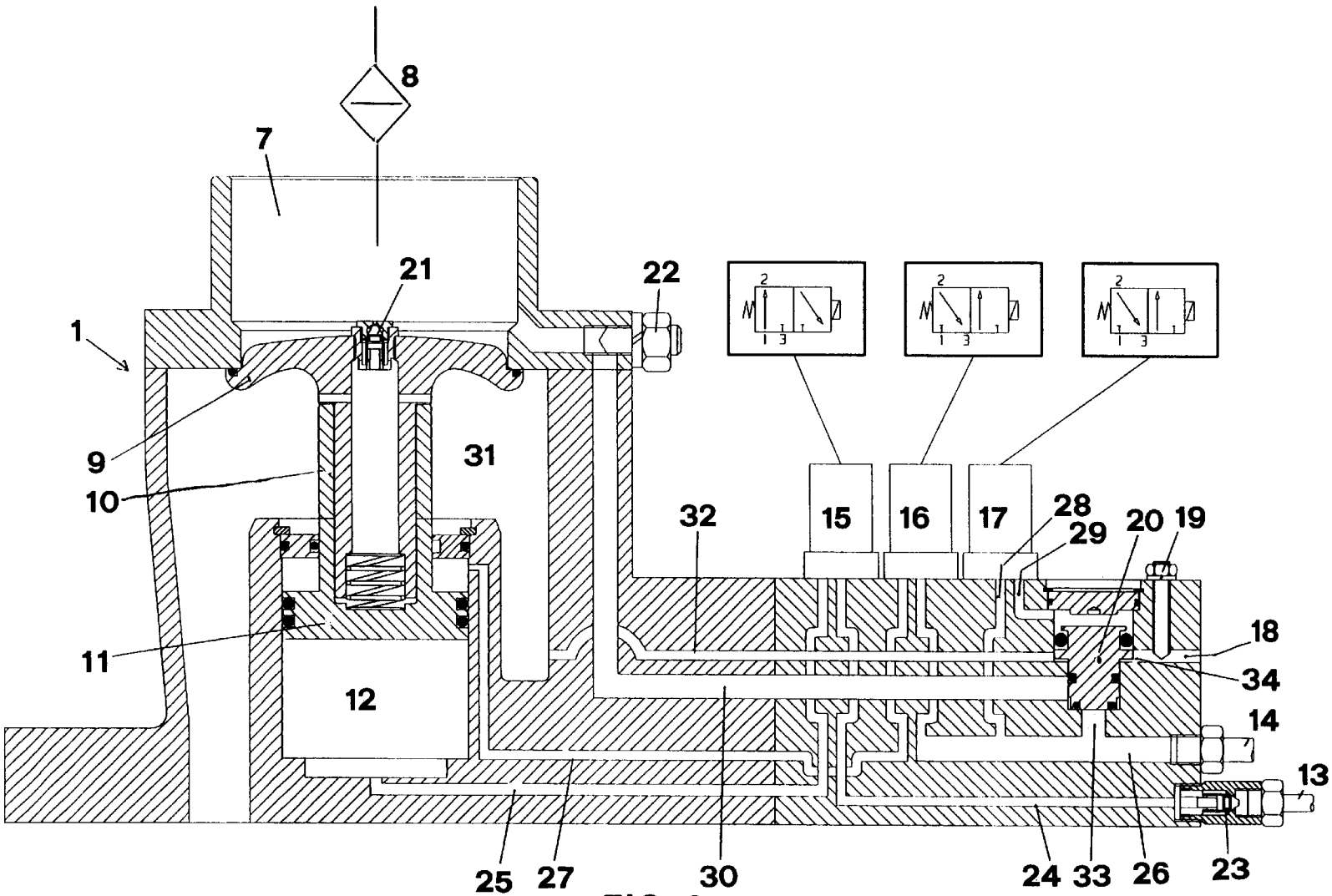
FIG. 2 shows a cross-sectional view of the regulator according to the invention in non-operative condition.

As shown in FIGS. 1 and/or 2, the installation for the production of compressed air is constituted essentially by the intake regulator (1) which cuts off air from the exterior and conveys it to the oil bath spin compressor (2) which is activated by electric motor (2A).

The mixture of oil/air fluid under pressure produced by the compressor enters the separator reservoir (3) where separation of air from oil takes place.

The pressurized air, regulated by a low pressure valve fills the reservoir of accumulation (5) and waits to be utilized, while the oil returns to the compressor (2) through the radiator (6).

The intake regulator (1) of this invention sucks in external air through the intake orifice (7) which is provided with filter (8). The intake orifice is controlled in opening/closure by means of the pan shutter (9) which is provided with tang (10), on which piston (11) is fitted, the piston being slidable within the chamber having variable volume (12).

In addition, the pressure regulator (1) is fed by two additional flows of air under pressure (13) and (14) which are removed from separator reservoir (3) and intercepted by the three electrovalves, (15), (16) and (17).

An orifice (18) for the intake of external air is provided on the body. The flow of air is regulated by means of a needle screw (19) and is intercepted by the small internal piston (20).

The regulator is completed with a small non-return valve (21) which is applied on the pan shutter (9) and with an adjustment screw (22) which regulates the discharge air conveyed in the intake orifice (7).

In operation, the first novel characteristic of the regulator of this invention resides in the start-up phase of the installation and is constituted by the fact that the pan shutter (9) remains closed without the help of springs and similar mechanisms capable of accomplishing the same.

Figure 3:
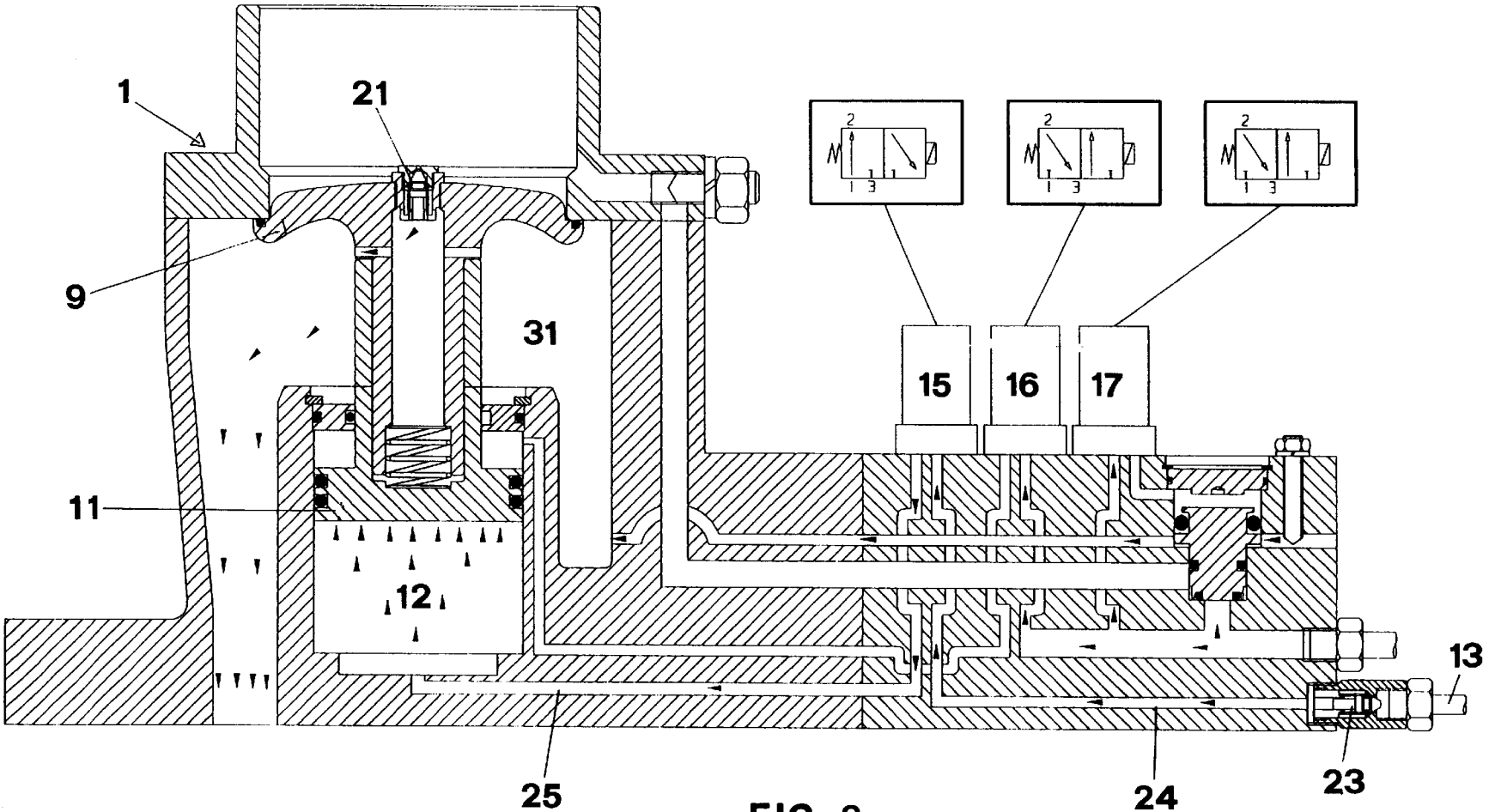
FIG. 3 shows the regulator of FIG. 2 under start-up condition of the installation.

In fact, as shown in FIG. 3, the closure of the regulator, during the start-up phase, is accomplished by inserting a non return valve (23) at the entry of the pressurized air flow (13) from the separator reservoir and by positioning the electrovalve (15) in the open position, whereby the two internal conduits (24) and (25) communicate and allow the pressurized air to act on piston (11) in the chamber (12) which has variable volume.

In this phase, the two further electrovalves (16) and (17) are in the closed position, which the small non return valve (21) applied on the pan shutter, allows the intake of a minimum flow of air from the exterior.

Figure 4:
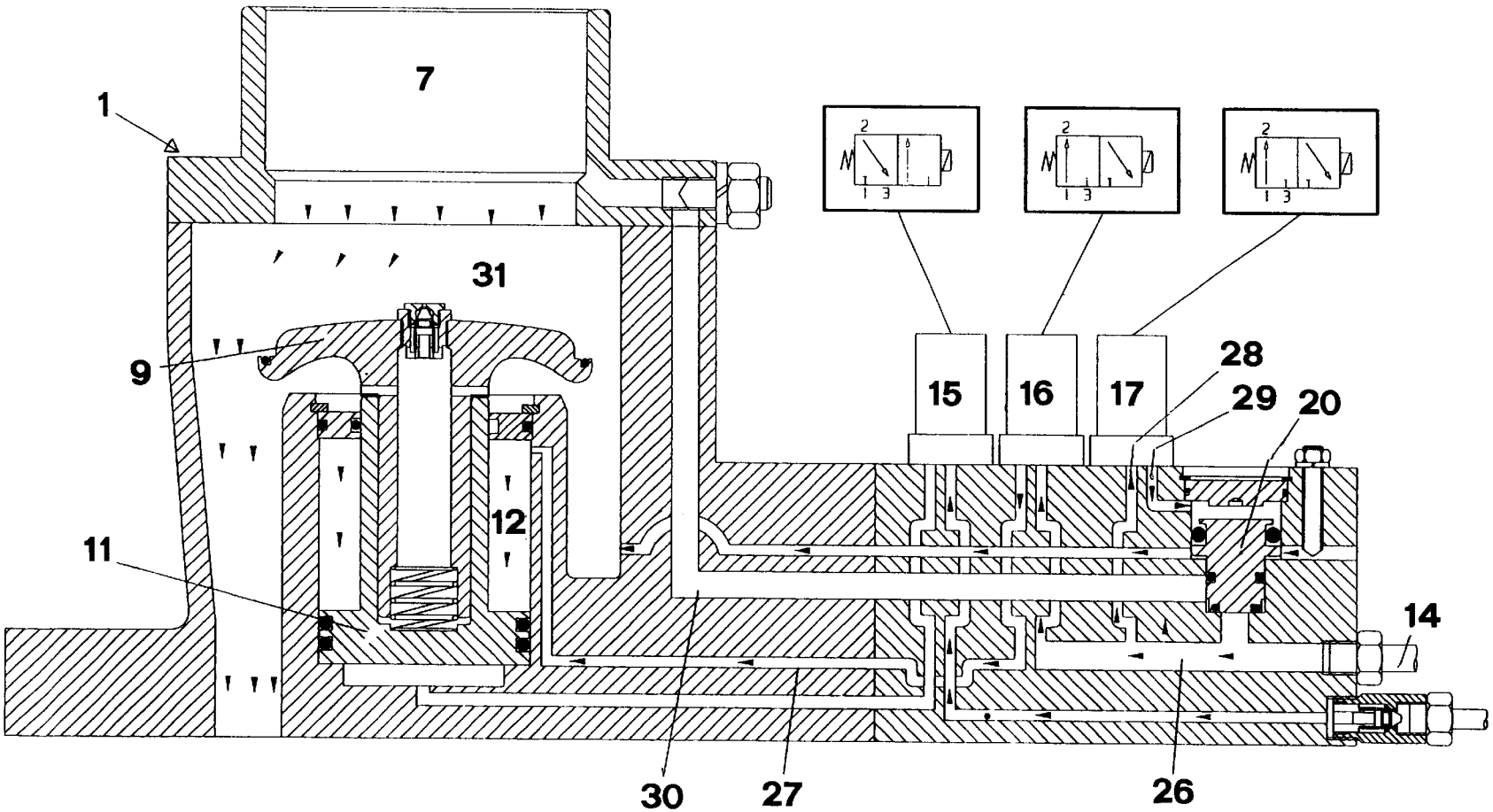
FIG. 4 shows the regulator of FIG. 2 functioning at full load.

Always operatively as shown in FIG. 4, in functioning at full load the electrovalve (15) returns to the closed position while the other two electrovalves (16) and (17) change to the open position. In this manner, the flow of pressurized air (14) acts on piston (11) through conduits (26) and (27) which intercommunicate through the opening of electrovalve (16), thus causing the lowing of shutter (9) and the opening of the intake orifice.

Still in this phase, the pressurized air flow (14) which goes through conduit (26) by means of diverted conduits (28) and (29) which intercommunicate through electrovalve (17) in the open condition, maintains force on the internal small piston (20) which closes conduit (30) for discharge of the pressurized air.

The second novel characteristic of the invention manifests itself in the unloaded functioning phase with the reservoir at maximum pressure and it is necessary to keep a minimum pressure in the interior of separator reservoir (3) to allow the lubrication of the spin group.

Figure 5:
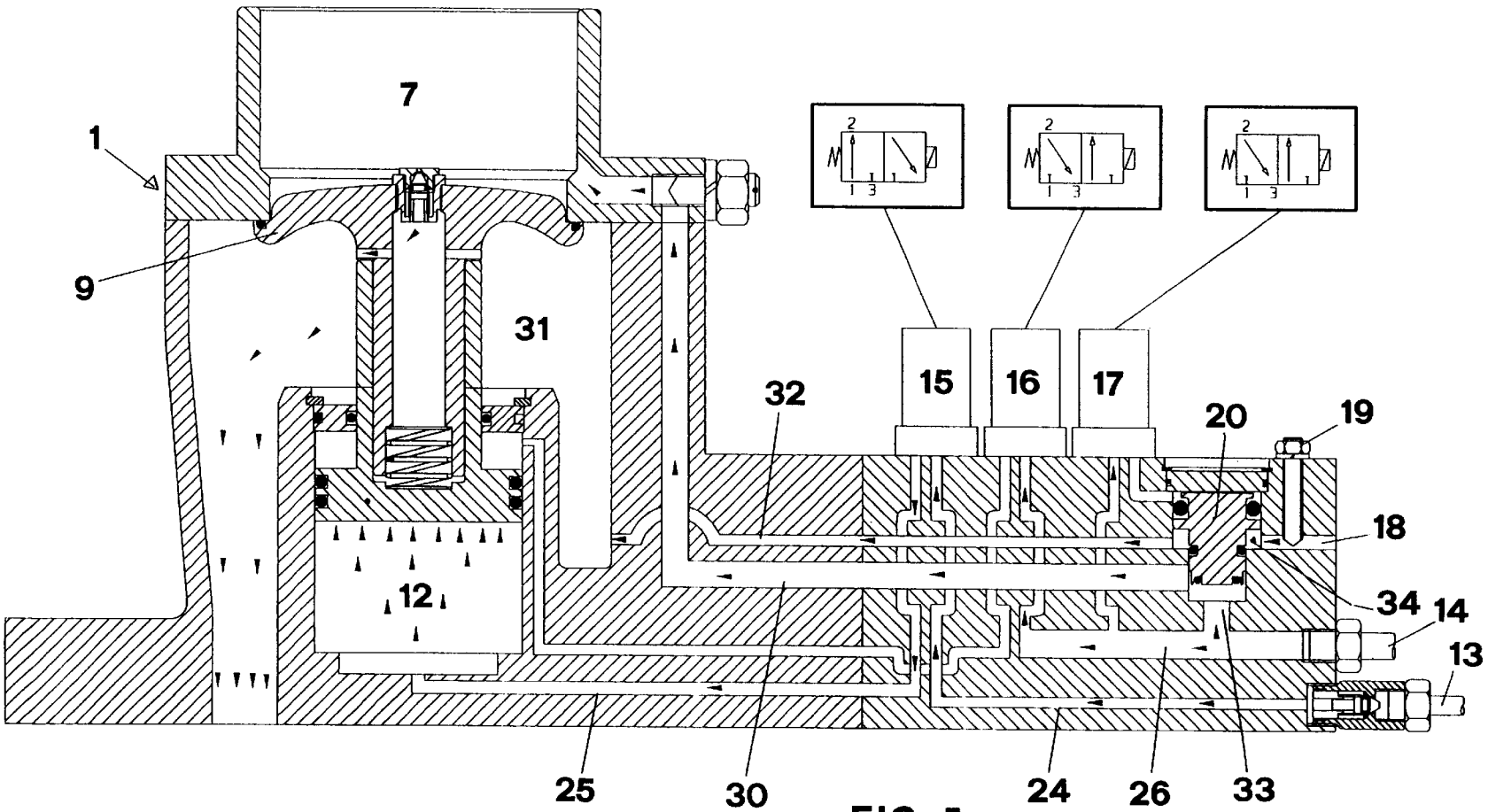
FIG. 5 shows the regulator of FIG. 2 functioning without load.

As shown in FIG. 5, in this phase the electrovalve (15) is open so as to allow the flow of air (13) through conduits (24) and (25), which keeps shutter (9) closed, while the other two electrovalves (16) and (17) are closed so as to send the flow of air (14) through conduits (26) and (30) to discharge in the intake orifice (7).

The novelty of the invention resides in the fact that the regulation of the minimum pressure of the flow of air in the circuit occurs in a balanced manner by means of the action of small piston (20), which being moved, regulates the amplitude of the passage space (33) which connects the two conduits (26) and (30).

The balancing of the piston (20) in a manner to maintain in the separator reservoir (3) the optimal minimum pressure is obtained due to the equilibrium between the vacuum created by the spin group in the intake chamber (31) and consequently in the connection conduit (32) which is intercepted by the same piston and the air pressure in conduit (26).

In more detail, the value of the vacuum in conduit (32) and particularly in the small annular chamber (34) defined by the small piston (20) which attracts towards the lower part the same piston, is regulated by means of needle screw (19) which closes in a manner more or less accentuated the orifice (18) of the entry of external air returned by the same vacuum.

By the way of example, with the needle screw (19) totally unscrewed and therefore with orifice (18) completely open, the value of the vacuum in conduit (32) is minimal so that piston (20) is completely raised and leaves open to the maximum the space of passage (33) so that the pressure in the interior of separator (3) drops to the lowest value.

On the other hand, by screwing almost completely the needle screw (19) orifice (18) is almost completely closed, so that the value of the vacuum in conduit (32) is increased and the piston (20) is recalled to a closed position and piston (20) closes almost completely the space of passage (33) and the pressure in the interior of the separator is maintained at the greatest value.

On the basis of what has been demonstrated with the examples, it is clear that with the balancing device, in functioning without load, the speed of discharge of the flow of air is totally independent of the value of the minimal pressure in the oil separator and in the lubrication circuit of the spin pump.

Finally, the third characteristic resides in the fact that the electrovalves (15) and (16) of the type with three paths are utilized for the opening/closing of the intake orifice, the electrovalves being provided with a calibrated discharge nozzle so as to ensure regular functioning, free of repercussions and/or of the blunt closure of the shutter which are cause of damage of the material, and in this manner materials may be used instead of steel such as aluminum for the construction of the body of the regulator.

Obviously, other embodiment different from the embodiment illustrated in the drawings are possible, without however, departing from the scope of the attached claims.

What is claimed is:

1. An air intake regulator for a compressed air production circuit, wherein the circuit includes an air intake regulator (1) which conveys external air to an oil bath spin compressor (2) actuated by an electric motor, a separator reservoir (3) for separating air from oil receives a mixture of pressurized oil/air from said compressor, an accumulation reservoir (5) receives pressurized air from said separator reservoir via a low pressure valve (4), a radiator (6) receives oil from the separator reservoir and returns it to the compressor, said air intake regulator comprising:

an air intake orifice (7) with a filter (8) through which external air is sucked;

a pan shutter (9) for controlling the opening and closing of said air intake orifice, said pan shutter having a tang (10) fitted with a piston (11) slidable within a variable volume chamber (12);

first and second flows of pressurized air (13 and 14) communicating with said separator reservoir and intercepted by first, second and third electrovalves (15, 16, 17); and an opening (18) for the intake of external air regulated by a needle screw (19) and intercepted by a small movable internal piston (20).

2. The air intake regulator for a compressed air production circuit as defined in claim 1, which further comprises a non-return valve (21) on said pan shutter (9) so as to permit a minimum air flow into an intake chamber (31) of said air intake regulator.

3. The air intake regulator for a compressed air production circuit as defined in claim 1, wherein said pan shutter remains in the closed position without the help of springs or similar devices.

4. The air intake regulator for a compressed air production circuit as defined in claim 3, which further comprises a non-return valve (23) inserted in said first flow of pressurized air (13), a first internal conduit (29, 25) communicating between said non-return valve and said variable volume chamber (12), wherein said first electrovalve (15) is disposed to interrupt said first internal conduit whereby during a start up phase said second and third electrovalves (16 and 17) are closed and said first electrovalve is in the open position so that pressurized air from said first flow of pressurized air (13) acts on said piston (11) to close said pan shutter (9) on said air intake orifice (7).

5. The air intake regulator for a compressed air production circuit as defined in claim 4, which further comprises a second internal conduit (26, 27) communicating between said second flow of pressurized air (14) and said variable volume chamber (12), wherein said second electrovalve (16) is disposed to interrupt said second internal conduit whereby when functioning at full load said first electrovalve is closed and said second electrovalve is in the open position so that pressurized air from said second flow of pressurized air (14) acts on said piston (11) to open said pan shutter (9) on said air intake orifice (7).

6. The air intake regulator for a compressed air production circuit as defined in claim 5, which further comprises a third internal conduit (26, 30) communicating between said second flow of pressurized air (14) and the intake orifice (7) upstream from said pan shutter (9), a fourth internal conduit (26, 28, 29) communicating between said second flow of pressurized air (14) and said small internal piston (20) which is disposed to interrupt said third internal conduit, wherein said third electrovalve (17) is disposed to interrupt said fourth internal conduit whereby when functioning at full load said first electrovalve is closed, said second electrovalve is open and said third electrovalve is open so that pressurized air from said second flow of pressurized air (14) acts on said small internal piston (20) to close said third internal conduit with respect to said second flow of pressurized air.

7. The air intake regulator for a compressed air production circuit as defined in claim 6, wherein when functioning without a load said first electrovalve (15) is open so that pressurized air from said first flow of pressurized air (13) acts on said piston (11) to close said pan shutter (9) on said air intake orifice (7), and said second and third electrovalves (16 and 17) are closed so that said fourth internal conduit (26, 28, 29) is interrupted and said small internal piston (20) permits the pressurized air from said second flow of pressurized air (14) to pass to said third internal conduit (26, 30) and discharge into said intake orifice upstream from said pan shutter.

8. The air intake regulator for a compressed air production circuit as defined in claim 7, wherein when functioning without a load the minimum air pressure in the circuit is regulated through the balancing of the action of said small internal piston (20) which moves to regulate the amplitude of the interruption in said third internal conduit (26, 30) and hence regulate the passage of pressurized air from said second flow of pressurized air (14) to said third internal conduit (26, 30).

9. The air intake regulator for a compressed air production circuit as defined in claim 8, wherein the balancing of the action of said small internal piston (20) is effected due to the equilibrium between the vacuum in an intake chamber (31) of said air intake regulator disposed downstream of said pan shutter (9) and the pressure of said second flow of pressurized air (14), the vacuum being transmitted to said small internal piston by a vacuum conduit (32).

10. The air intake regulator for a compressed air production circuit as defined in claim 9, comprising a chamber (34) formed below said small internal piston (20) communicating with said vacuum conduit (32) and said intake orifice (18) wherein the vacuum is regulated by regulating said needle screw (19) in said opening (18).

11. The air intake regulator for a compressed air production circuit as defined in claim 9, wherein when functioning without load the speed of the discharge of the flow of air is independent of the minimum pressure present in the separator reservoir (3) and in the lubrication circuit of said spin compressor (2).

12. The air intake regulator for a compressed air production circuit as defined in claim 7, wherein said first and second electrovalves (15, 16) have three paths for the opening/closing of said intake orifice (7) wherein in a discharge path a calibrated nozzle is provided so as to prevent recoil and sudden closure of the pan shutter.

* * * * *

UNITED STATES PATENT AND TRADEMARK OFFICE

CERTIFICATE OF CORRECTION

PATENT NO. : 6,715,998 B2
DATED : April 6, 2004
INVENTOR(S) : M. Virgilio

It is certified that error appears in the above-identified patent and that said Letters Patent is hereby corrected as shown below:

Title page,
Item [30], Foreign Application Priority Data, should read
-- April 19, 2001 (IT)…….VI2001A000086 --.

Signed and Sealed this

Twenty-ninth Day of June, 2004

JON W. DUDAS
*Acting Director of the United States Patent and Trademark Office*